United States Patent [19]

Schlinsog

[11] 4,292,095

[45] Sep. 29, 1981

[54] PROCESS FOR HYDROPHILIZATION OF METAL SURFACES AND/OR METAL OXIDE SURFACES

[75] Inventor: Hans-Juergen Schlinsog, Cremlingen, Fed. Rep. of Germany

[73] Assignee: The Continental Group, Inc., Stamford, Conn.

[21] Appl. No.: 77,437

[22] Filed: Sep. 20, 1979

[30] Foreign Application Priority Data

Dec. 20, 1978 [DE] Fed. Rep. of Germany ..... 2855170

[51] Int. Cl.[3] ..... C23F 7/00; C23F 7/06

[52] U.S. Cl. ..... 148/6.14 R; 148/6.27; 72/46; 204/58

[58] Field of Search ..... 148/6.27, 6.14 R; 204/58, 35 N; 72/46

[56] References Cited

U.S. PATENT DOCUMENTS

| | | | |
|---|---|---|---|
| 2,369,596 | 2/1945 | Millen | 148/6.35 X |
| 3,231,376 | 1/1966 | Sorkin et al. | 148/6.27 |
| 3,266,900 | 8/1966 | Zelly | 148/6.27 |
| 3,549,372 | 12/1970 | Richlin et al. | 148/6.27 |
| 4,028,205 | 6/1977 | Dorsey | 148/6.27 |
| 4,149,912 | 4/1979 | Craighead | 148/6.27 |

OTHER PUBLICATIONS

Suzuki, Chem. Abs., 83:83811c (1975).

Swiss Aluminum Ltd., Chem. Abs. 67:14436s (1967).

*Primary Examiner*—Ralph S. Kendall

*Attorney, Agent, or Firm*—Paul Shapiro

[57] ABSTRACT

This relates to the hydrophilization of metal surfaces and/or metal oxide surfaces. In the forming of sheet metal by drawing and wall ironing methods, in the past it has been necessary to provide lubricants so as to not only protect the metal, but also to hold down friction noises. The lubricants are difficult to remove and require expensive washing processes after the forming operation. It has been found that an hydroxide of the metal involved may be readily generated on the surface so that the surface is easily wetted by water, for example, and thereby conventional lubricants are eliminated.

11 Claims, No Drawings

PROCESS FOR HYDROPHILIZATION OF METAL SURFACES AND/OR METAL OXIDE SURFACES

This invention relates to a process for hydrophilization of metal surfaces and/or metal oxide surfaces.

As is well known, the surfaces of metals, except for noble metals, undergo a chemical change from pure metal to an oxygen-containing compound due to atmospheric influences. With most metals, except for noble metals, such surface layers include an oxide layer and/or a mixed oxide layer and/or an oxide/hydrate layer and/or an oxide/hydroxide layer and/or an oxide/hydroxide/hydrate layer and/or an oxygen-containing metal complex compound layer.

Aluminum is known to have a surface layer in the form of an only few molecules thick, hard, continuous, transparent oxide layer which is formed, for instance, on freshly scored aluminum in contact with air or water after not more than a few seconds.

Initially, such protective layer has a thickness of only a few Angstrom. However, it will grow to 45–90 Angstrom within one month and will stay almost unchanged thereafter.

The surface of iron is formed of mixed iron oxides, i.e. oxides of trivalent iron, in not clearly definable equivalents of oxygen, hydrogen and iron.

In contrast to aluminum, tin and chrome surfaces, the surface or iron cannot be delaminated mechanically by means of a relatively soft abrading material, e.g. paper, as was proven experimentally. Delamination is understood to be a mechanical transfer of the oxide layer onto the abrading material.

The surface of tin-coated steel plate is formed of the following layers: mixture of tin-(IV)-oxxide layer and tin-(II)-oxide layer, tin layer, tin-iron alloy layer and finally and iron layer underneath. Such tin-coated iron plates are known as tin plates, which are commonly marketed with passivated and greased surfaces. The passivation layer (e.g. chrome layer) may have been applied either chemically or electrochemically.

The tin quantity is standardized, e.g. according to Euronorm 77–65 specifying E 1–E 4, or according to ASTM A624 comprising designations No. 10—No. 135/25. ASTM A624 also contains specifications of common types of chemical surface treatments and the amount of e.g. chrome in the passivation layer. According to ASTM A624, the chrome used in chemical passivation (chromic acid-treated tin plate) amounts to not more than 250 $\mu$g chrome/ft$^2$ surface, whereas the amount used in electrochemical passivation (cathodic sodium dichromate-treated tin plate) is about 500 $\mu$g chrome/ft$^2$.

Moreover, tin plate is normally greased. Common greasing agents are e.g. dioctyl sebacate (DOS), cottonseed oil and butyl stearate (ATBC). Usually film weights are 0.10 g/base box–0.40 g/base box according to ASTM A624.

The surface of electrolytically chrome-plated iron plate (black plate) includes a chrome-(III)-oxide layer and a metallic chrome layer. According to ASTM A657, the metallic chrome coating contains between 3 and 13 mg chrome/ft$^2$ surface and the chrome oxide layer on top of it contains 0.3–0.4 mg chrome/ft$^2$. The surface of electrolytically chrome-plated black plate is also greased in the same way as the tin plate mentioned above.

Surprinsingly it was found that plates, especially aluminum plates, tin-coated iron plates, chrome-plated iron plates and iron plates per se may be subjected to mechanical forming processes, especially to deep-drawing or wall-ironing, without the use of lubricants hitherto considered indispensable, if the plate surface is hydrophilized, i.e. made hydrophilic.

According to a preferred embodiment of the invention, such hydrophilization is accomplished by the generation of a hydroxide of the metal involved or a hydroxide-containing compound of the metal involved on the surfaces of such metals and/or metal oxides. According to a preferred embodiment of the subject invention, it is especially a hydroxide of the lowest valence stage of the metal which is generated on the surfaces.

Metal surfaces hydrophilized in accordance with this invention show technologically extremely interesting, unexpected properties; in particular, apart from mechanical forming processes like deep-drawing or wall-ironing without lubricants hitherto considered indispensable, much more efficient and thus more economical coatings can be achieved.

Hydrophilization of sheet metal surfaces is described below by way of a few examples.

EXAMPLES OF HYDROPHILIZATION

Example 1

A sheet of aluminum of DIN A4 dimensions, 0.3 mm thick, composition: silicium 0.30, iron 0.70, copper 0.25, manganese 1.0–1.5, magnesium 0.3–1.3, zinc 0.25, balance aluminum (% by weight), is hydrophilized by reciprocating a paper fleece across the surface of the sheet 5 times, with an average pressure of 1 kg/cm$^2$ being exerted. As a rule, this frictional movement is performed as many times as are required to make a residue from the aluminum surface visible on the paper fleece used for rubbing (black discoloration of the paper fleece). Evidence of the change of the hitherto hydrophobic aluminum surface to a hydrophilic surface due to this treatment is obtained as follows:

Prior to the mechanical hydrophilization, the completely degreased aluminum surface is hydrophobic, which can easily be demonstrated by water poured on the vertical aluminum plate and running down in small and smallest droplets, or by adsorption of conventional offset printing inks on the surface, i.e. a hydrophobic reaction.

Aluminum plate treated by the hydrophilization process described can be identified as hydrophilic by pouring water on a vertical plate which causes complete wetting of the aluminum surface, which has been mechanically treated as described above, and remains there for about 60 seconds, after which time the water evaporates gradually from top to bottom, and the plate surface no longer adsorbs offset printing ink.

This example of offset printing ink adsorption will also serve to show that the surface reactions leading to the contrary properties hydrophilic→hydrophobic have not been adequeatly investigated by scientists yet. The metal hydroxide of the lowest valence stage disclosed by this invention is made somewhat clearer by the offset printing ink example: if a hydroxide of the known valence stage were present, the ink could be rinsed down or, unless disassociated, the ink could be removed from the surface by rubbing with wet printing ink. This is of particular interest of noble metals (copper) side-by-side with base metals (Cr, Fe, Al, Sn) are treated in the described manner. Copper will always hold ink, as will the oxides of base metals which are hydrophobic; hydroxides of base metals are hydrophilic until they gradually become again hydrophobic due to oxidation.

Water poured on the surface anew will again be adsorbed on the surface, i.e. the surface will stay hydrophilic for about 24 hours, as was proven experimentally. After 24 hours, the metal surface will slowly and gradually become again hydrophobic.

Example 2

A sheet of aluminum of the type specified in Example 1 is chemically hydrophilized by immersion in a 1n-sodium hydroxide solution for 30 minutes; the sodium hydroxide solution having a temperature of 60°-80° C. The aluminum sheet is then removed from the sodium hydroxide solution and rinsed with distilled water until the rinsing water no longer shows alkalinity. Then the hydrophilization test described in Example 1 will be performed by observing the speed of the water running down the vertical sheet. The tests will show that the degree of hydrophilization achieved by the chemical treatment described in this example is equal to that for the mechanical hydrophilization described in Example 1.

Example 3

A sheet of aluminum of the type specified in Example 1 is immersed in an electrolyte consisting of 0.5% sodium hydroxide solution at room temperature (25° C.).

Anodic current of 70 $A/m^2$ is applied (related to the surface area of the aluminum). After not more than 2 seconds the entire aluminum sheet will be of equal hydrophilic nature as the sheets treated in accordance with Examples 1 and 2. Also in this case the sheet is rinsed with distilled water until the draining distilled water is free from alkali. The method of determining hydrophility is the same as described in the foregoing examples.

Example 4

Aluminum sheet of the type described in Example 1 is placed in an electric oven and heated to a temperature on the order of 200° C. for a time on the order of 6 minutes. The sheet is then removed from the electric oven and cooled to room temperature in standard laboratory atmosphere. Then the hydrophility test described in detail in Example 1 was carried out; the test result shows that the sheet exposed to such thermal treatment has the same degree of hydrophility as the sheets described in Examples 1 through 3. In this particular case, an even longer hydrophilic condition is accomplished; it lasts for at least 36 hours.

Example 5

A sheet of tin plate of DIN A4 dimensions is subjected to the hydrophilization processes described in Examples 1 through 4.

Tin plate which was mechanically hydrophilized in a method analogous to Example 1 proved to stay hydrophilic for a period of 100 hours, whereafter it slowly lost its hydrophility.

The treatment with sodium hydroxide solution was performed completely analogous to Example 2. The hydrophilization result was equal to that in the preceding example.

Example 6

A sheet of tin plate DIN A4 is immersed in the NaOH electrolyte as above and then first used as anode for one second, thereafter as cathode for one second, then again as anode for one second, followed once more by one second as cathode. The current density was again 70 $A/m^2$ tin plate.

After completion of this electrochemical treatment, the tin plate was removed from the bath and rinsed with distilled water until the rising water showed no further alkalinity. The hydrophility achieved was measured by applying the hydrophility test with the sheet in vertical position as described above in detail.

The hydrophility of the tin plate sheet which had been subjected to the electrochemical treatment persisted for 100 hours, too, and then decreased slowly.

Example 7

A chrome-plated iron plate of DIN A4 dimensions was treated mechanically by means of a super-fine polishing mop (of plastic fabric) on which a pressure of 5 $kg/m^2$ was exerted; the super-fine polishing mop being moved up and down over the surface five times.

Such mechanical treatment proved to cause hydrophilization of the previously hydrophobic chrome-plated iron plate surface. Hydrophilization was again determined by applying the standard test described above; hydrophilization persisted for 5 hours and then decreased slowly.

Example 8

The surface of a DIN A4 sheet of chrome-plated iron plate is chemically treated by rubbing a mixture of 10% gelatin and 2% glycerin and 88% water adjusted to a pH 2 by means of thinned sulfuric acid onto the surface or by immersing the sheet into the described solution for 5 seconds. Instead of immersing the sheet, the surface of the chrome-plated iron sheet may be subjected to 5 rubbing movements of a chemically inert fleece.

Thereafter the sheet is rinsed until the rinsing water turns neutral, as described above in detail.

The hydrophility test described above was applied and showed that the hydrophility of the chemically treated chrome-plated iron sheet persisted for 100 hours.

Example 9

A sheet of chrome-plated iron plate of DIN A4 dimensions is thermally treated for 6 minutes in an electric oven with an inside temperature of 200° C. and then removed from the oven. After cooling to room temperature the chrome-plated iron plate thermally treated in this manner was hydrophillic for a period of 100 hours.

Example 10

A sheet of iron plate of DIN A4 dimensions, 0.3 mm thick, (plain), so-called black plate of the composition: C 0.06%, Si 0.01%, Mn 0.25%, P 0.010%, S 0.020%, balance iron, is immersed in an electrolyte bath of 0.25 n-sodium hydroxide solution. The black plate was then first used as cathode for one second, then as anode for one second, and then once more as cathode for one second. The current density was again 70 $A/m^2$ sheet. It was then removed from the electrolyte path and washed with distilled water until the rinsing water was free from alkali. Thereafter the hydrophility test was performed as described above; black plate electrolytically treated in the described manner proved to stay hydrophilic for one hour. After that period, the surface of the black plate does not turn hydrophobic; instead, formation of distinctly colored iron oxide begins, which is hydrophilic.

Another fact discovered, which represents an essential part of this invention, is that the hydrophilic condition of metal surfaces hydrophilized in the ways described above and/or metal oxide surfaces can be preserved temporarily.

Preservation is accomplished by applying, preferably immediately upon completion of the hydrophilization process, a coating of a chemical composition which is soluble in both water and organic solvents; preferred coating materials are glycols, amines, alkanol amines as well as gelatin and gelatin-like substances.

Other suitable coating agents are gum arabic, isoparaffins and/or polyparaffins in the form of solutions and/or emulsions.

These coating agents produce the desirable effect of excluding and/or preventing access of air oxygen and/or air humidity to the hydrophilic metal surfaces and/or metal oxide surfaces.

An example of how a hydrophilized metal surface is preserved is described below.

Example 11

The aluminum sheet hydrophilized as per Example 1 is preserved immediately upon completion of the hydrophilication treatment by applying tetraethylene glycol, for instance by spraying; alternatively, the preservation effect can be achieved by passing the hydrophilized metal sheet through a tetraethylene glycol bath immediately after hydrophilization.

Further preserving agents are esters of montanic acid with glyol and/or 1.3-butanediol, acetin, polyethylene glycol, copolymer of esters of acrylic acid with monovalent aliphatic alcohols $C_1$–$C_4$, mixture of alkylphenol polyglycol ether with 20 ethylene oxide groups, alkylphenol polyglycol ether formaldehyde acetate and $C_{12}$–$C_{18}$ fatty alcohol polyethylene glycol polypropylene glycol ether, polyvinyl acetate of aliphatic saturated aldehydes $C_1$–$C_6$ of a molecular weight above 1,000, dibutyl sebacate, acetyl tributyl citrate, acetyl-tri-2-ethyl-hexyl-citrate, diphenyl-2-ethyl-hexyl-phosphate, adipic acid polyester with 1.3- and 1.4-butanediol, acidic esters of phosphoric acid with monovalent, saturated, aliphatic alcohols of $C_2$–$C_4$ chain length.

The duration of the preservation depends on the intensity and time of the preserving treatment; the duration of the preservation will at least suffice to warrant the further steps of processing of the hydrophilized surfaces, for which the hydrophilic character has to be retained.

The invention is furthermore based upon the surprising discovery that the hydrophilization of metal surfaces and/or metal oxide surfaces is accomplished by a generation of hydroxyl-containing compounds on the surface.

The overall surprising behavior of the metal surfaces hydrophilized in accordance with the subject invention can be explained, with the current state of knowledge, only by a formation of at least hydroxyl group-containing compounds of the lowest valence stage of the metal involved during the hydrophilization process, whereby it is of no concern within the scope of this invention how many valences of the metal involved are saturated by hydroxyl groups.

From the four hydrophilization processes described, i.e. the mechanical, the chemical, the electrochemical, and the thermal methods, an expert will be able to derive that the naturally grown oxides on the surface were removed and hydroxyl group-containing compounds were subsequently formed or released from internal areas by the thermal hydrophilization process.

The explanation of the present invention is also supported by the figures for energy of formation of metal oxides and/or metal hydroxides from the particular metallic condition listed on the following table:

| | |
|---|---|
| 2+ Fe=O | 64 kcal/Mol |
| 2+ Fe(OH)(OH) | 135 kcal/Mol |
| 3+ Fe(=O)(O—)(OH) | 190 kcal/Mol |
| 3+ Fe(OH)(OH)(OH) | 197 kcal/Mol |
| $Fe_3O_4$ 2+ Fe(O—Fe=O)(O—Fe=O) | 266 kcal/Mol |
| 2+ Sn+O | 69 kcal/Mol |
| 2+ Sn(OH)(OH) | 136 kcal/Mol |
| 4+ Sn(=O)(=O)(OH)(OH) | 138 kcal/Mol |
| 3+ Al(OH)(OH)(OH) | 304 kcal/Mol |
| 3+ $Al_2O_3$ | 390 kcal/Mol |
| Cr(OH)(OH)(OH) | 245 kcal/Mol |
| $Cr_2O_3$ | 267 kcal/Mol |

It is evident from this table, for instance, that the energy of formation of the oxide of bivalent iron is substantially lower than the energy of formation of the hydroxide of bivalent iron, whereas the energy of formation of the hydroxide of trivalent iron is substantially larger than that of the hydroxide of bivalent iron. Finally, the energy of formation of the ferroferri oxides is largest.

It is evident from the table that the stability especially of the hydroxide of trivalent iron is not too far away from the stability of the most stable body, viz. of $Fe_3O_4$.

It is furthermore evident from the table that the gap between the values for energy of formation of the hydroxide of bivalent tin and the oxide of tetravalent tin is very small, i.e. only 2 kcal/Mol. This is the explanation for the high stability and long duration of hydrophilized tin on tin plate.

Also in the case of aluminum plate, the gap between the values for energy of formation for the hydroxide of trivalent aluminum and the oxide of trivalent aluminum is relatively small. It is 304 vs. 390 kcal/Mol, but the residual energy of 86 kcal/Mol is so large that the stability of the hydroxide is relatively smaller than that of tin, iron and chrome.

The energy of formation of the hydroxide of trivalent chrome amounts to 245 kcal/Mol, compared with 267 kcal/Mol energy of formation of the oxide of trivalent chrome. It is hardly higher than that of the hydroxide, which will again explain the considerable stability and duration of the hydrophilic stage of chrome-plated sheet metal.

Chemical proof of the existence of hydroxyl-containing metal compounds on the surface of hydrophilized metals is given by the fact that a condensation with hydroxyl group-containing organic substances, like e.g. salicylic aldehyde, occurs, as was shown experimentally.

Analytical proof of the existence of free OH ions was furthermore obtained by unequivocal determination of fee OH ions in aqueous medium on the surface of hydrophilized metals by means of the standardized indicator neutral red.

One of the surprising methods of application of hydrophilized plate in wall-ironing for the purpose of manufacturing beverage cans is described below.

An example of the use of aluminum plate hydrophilized in the manner described above is in wall-ironing without using a lubricant.

Up to now, metal sheets without clear definition of the metal oxide and/or metal hydroxide structure were used. Cases are known where an oxide layer was intentionally produced on the assumption that hydrophobic wall-ironing lubricants would thus show improved adherence.

Aluminum plate hydrophilized and preserved analogous to one of the processes described in the examples is formed into cups and immediately immersed in an inert solution consisting of isopropanol and 0.5% triethanolamine, in order to renew the preserving effect.

Such hydrophilic and re-preserved cups are fed to the cupping press taking special care of rapid processing.

Surprisingly, it was found that these cups may be formed into cans without any coolant—i.e. dry—or with a coolant such as the above preserving solution, without shrieking and scratching.

Since the extremely efficient coolant water was missing in this case, the length of the workpiece increased after production of 8 cans in a dry condition and after 22 cans when using isopropanol and triethanolamine (0.5%), so that the test had to be stopped. After cooling down of the dies (to room temperature, within 45 minutes), the test could be repeated with identical results.

One skilled in the art will be able to appreciate that this application is far from being suitable for commercial production, since in the first instance proof has to be offered that the hydrophilized metal surface does not release oxides during mechanical deformation, as is common for conventional hydrophobic surfaces; mechanical deformation without lubricants will visibly abrade the can surface after two cups have passed, which also causes the shrieking noise.

A skilled person will be able to appreciate that the process heat has to be dissipated by means of intensely cooled external or internal media, if water is to be dispensed with, in order to ensure continuous production. The increase of the can length is a clear hint to punch cooling, since the reduced gaps between rings and punch are caused by thermal expansion of the punch. Cans with a wall thickness below 0.06 mm are off-standard and cannot pass through the subsequent operations without problems.

A microscopic examination of a can so produced may reveal milky veils on the can outside, but this does not impair the optical appeal of the can.

The hydrophility test is positive, i.e. the hydrophilized surface persists or, related to the ultimate surface, has been regenerated at a rate of 50% analogous to the hydrophility examples applying mechanical friction energy.

Compared to a can produced by the standard process, i.e. in the presence of lubricants, and having a hydrophobic surface, the surface of the metal can is homogeneous, hydrophilic in all can areas and, in contrast to a can produced by the standard process, need not be made hydrophilic in an alkaline cleaning bath.

This is a special feature of the metal can surface produced in accordance with the subject invention.

A skilled person will be able to appreciate that the hydrophilization process has to be designed simpler and easier to control if this is to be performed on a coil, i.e. prior to deformation, rather than on individual units which are contaminated with lubricants in the complex surface area of the can bottom contour.

Applicant observed during wall-ironing without lubricants that such parts are detached from the surface under the tensile and shear forces exerted during the mechanical deformation which were removed by the paper fleece in the hydrophilization experiment described above. It is evident that material may build up on the clearly defined working radius of the dies, whereby the working radius is changed. As a consequence, the relation between tensile and shear forces is changed such that the formed body in the machine breaks. In wall-ironing, the working radius is the radius under which the material is reduced. Angles most commonly used range between 10° and 6°. With such working angle and applying the formula $p3 = p1 - p2$, optimum tensile strength of the ready drawn workpiece will be warranted; for details refer to the technical literature on deep-drawing. To avoid tearing off which, as a rule, is first indicated or made noticeable by a change of the working radius, it has been considered indispensable with the present state of the art to apply conventional lubricants on the surfaces of both the workpieces and the wall-ironing dies for the wall-ironing process. Common lubricants are for instance: aqueous 3–20% oil emulsions, correction of pH e.g. from pH6 to pH9 for the purpose of biological protection. Furthermore, rust inhibitors are added; synthetic lubricants, as for instance polyclycols, are also used.

Experiments with tin plate showed that, if no conventional lubricants are used, the can surface is immediately roughened, so that, when the third can had passed through the die, distinct noise, warped surfaces and torn-off cans were already observed. If, however, the original material used is plate hydrophilized in accordance with this invention, it sill surprisingly be evident that the wall-ironing operation can be performed without lubricants hitherto considered indispensable, whereby no cracking, no shrieking, i.e. the typical friction noise, will be encountered.

The surface of the wall-ironed sheets shows the same smoothness and softness as that of sheets which were wall-ironed with the use of lubricants. Application of a hydrophilized surface in accordance with the subject invention offers a whole bundle of advantages.

Wall-ironing of sheets hydrophilized in accordance with the invention will lead to such wall-ironed parts which may be subjected to a coating process without any additional pretreatment, especially without any additional cleaning treatment. Such coating processes are, among others: spray-lacquering, wash-coating, powder coating, roller coating.

The roller coating process is to be applied for outside coating, the spray-lacquering and the powder coating processes are preferably to be applied for inside coating. Wash-coating is commonly used for simultaneous inside and outside coating.

Surprisingly, it was furthermore noted that the surface of hydrophilized wall-ironed parts has a better affinity and a better adhesive strength with the coating lacquer than the surface of non-hydrophilized sheets which were wall-ironed in the conventional manner using lubricants. This effect also means progress by leaps. It is understandable that a film of lubricant, once applied on the metal surface, cannot be 100% removed from all areas in any case, therefore lacquer application on such sheet metal surfaces which were first lubricated and then cleaned again is always more problematic than lacquer application on metal surfaces which never were in contact with lubricants.

Another very significant step forward in the use of hydrophilized metal surfaces for coating is accomplished by large-scale saving of agents no longer required for the removal of lubricants prior to coating due to the elimination of lubricants from the process as well as by substantial elimination of environmental hazards.

In the case of conventional lubricant-using-wall-ironing processes, the lubricants had to be removed in large cleaning units by means of solvent-containing cleaning agents. Another process uses aqueous alkalis for the removal of lubricants by saponification.

All processes require large amounts of energy and produce large amounts of toxic effluents or toxic solvent residues. All these ecologically hazardous cleaning processes are eliminated when plate hydrophilized in accordance with the invention is used for wall-ironing.

It was outlined above that metal surfaces hydrophilized in accordance with the invention may be stabilized, if required, by such agents which are soluble both in water and in organic solvents, for example by glycols.

It metal surfaces stabilized in the described manner are used for wall-ironing and subsequent coating, it may be observed that a large portion of the glycol evaporated during the wall-ironing process; this portion, however, is very small compared with the organic substances formerly required for the removal of lubricants. Small residual amounts of the stabilizer glycol, which may not be fully excluded, are compatible with the coating. As a matter of fact, stabilizers such as glycols and amines are normally components of coating materials.

What is claimed as new is:

1. A process for forming a hollow metal article from a metal sheet which comprises the steps of sequentially effecting in the absence of any intermediate step hydrophilization of metal surfaces and/or metal oxide surfaces of the sheet by generating at least one hydroxide of the metal involved on such surfaces, the hydroxide being of the lowest valence stage of the metal and then forming the hydrophilized sheet into the hollow article.

2. A process for hydrophilization of metal surfaces and/or metal oxide surfaces according to claim 1 wherein said one hydroxide is of the lowest valence stage of the metal involved.

3. A process for hydrophilization of metal surfaces and/or metal oxide surfaces according to claim 1 wherein said one hydroxide is a hydroxide-containing compound of the metal involved.

4. A process according to claim 1 wherein the one hydroxide of the metal involved is formed by rubbing said surface.

5. A process according to claim 1 wherein the one hydroxide of the metal involved is formed by rubbing said surface with a fleece at least five times across said surface at an average pressure of 1 $kg/cm^2$.

6. A process according to claim 1 wherein the one hydroxide of the metal involved is formed by immersion in 1n-sodium hydroxide solution.

7. A process according to claim 1 wherein the one hydroxide of the metal involved is formed by immersion in 1n-sodium hydroxide solution at a temperature of 60°–80° C. for 30 minutes.

8. A process according to claim 1 wherein the one hydroxide of the metal involved is formed by heating to a temperature on the order of 200° C. for a time period on the order of 6 minutes.

9. A process for forming a hollow metal article from a metal sheet which comprises the steps of sequentially effecting in the absence of any intermediate step hydrophilization of metal surfaces and/or metal oxide surfaces of the sheet by generating at least one hydroxide of the metal involved on such surfaces and then forming the hydrophilized sheet into the hollow article, the hydroxide of the metal being formed by immersion in an electrolyte consisting of 0.5% sodium hydroxide solution and applying an electrical current.

10. A process according to claim 9 wherein an electrical current of 70 $A/m^2$ is applied.

11. A process according to claim 10 wherein the electrolyte is at room temperature and the current is an anodic current.

* * * * *